United States Patent [19]

Van Tuijl

[11] Patent Number: 5,059,888

[45] Date of Patent: Oct. 22, 1991

[54] SERIES VOLTAGE REGULATING CIRCUIT HAVING A PARALLEL STABILIZER

[75] Inventor: Adrianus J. M. Van Tuijl, Nijmegen, Netherlands

[73] Assignee: U.S. Philips Corporation, New York, N.Y.

[21] Appl. No.: 501,648

[22] Filed: Mar. 29, 1990

[30] Foreign Application Priority Data

Apr. 13, 1989 [NL] Netherlands ..... 8900919

[51] Int. Cl.[5] ..... G05F 1/613

[52] U.S. Cl. ..... 323/224; 323/266

[58] Field of Search ..... 323/223, 224, 225, 226, 323/229, 265, 266, 270, 273, 274, 280, 281

[56] References Cited

U.S. PATENT DOCUMENTS

| | | | |
|---|---|---|---|
| 3,124,697 | 3/1964 | Trenehard | 323/224 |
| 3,742,330 | 6/1973 | Hodges et al. | 323/266 |
| 4,254,372 | 3/1981 | Moore | 323/280 |
| 4,341,990 | 7/1982 | Davis | 323/273 |
| 4,366,432 | 12/1982 | Noro | 323/226 |
| 4,549,129 | 10/1985 | Hing et al. | 323/224 |
| 4,555,660 | 11/1985 | Von Winnicki | 323/224 |
| 4,618,812 | 10/1986 | Kawakami | 323/266 |
| 4,628,249 | 12/1986 | Ikefuji et al. | 323/224 |
| 4,658,201 | 4/1987 | Notohamiprodjo | 323/266 |
| 4,743,833 | 5/1988 | Johnson | 323/224 |
| 4,754,388 | 6/1988 | Pospisil | 323/266 |
| 4,761,722 | 8/1988 | Pruitt | 323/224 |
| 4,801,859 | 1/1989 | Dishner | 323/224 |
| 4,972,136 | 11/1990 | Banura | 323/281 |

*Primary Examiner*—Steven L. Stephan
*Assistant Examiner*—Jeffrey Sterrett
*Attorney, Agent, or Firm*—Bernard Franzblau

[57] ABSTRACT

A voltage-regulating circuit comprises a series voltage stabilizer which includes a regulation element ($Q_1$) arranged in series with an output for supplying an output voltage to a load ($Z_L$). A comparison circuit (Q2–Q7) control the regulation element. The comparison circuit has a first input connected to a reference-voltage circuit (T3, D1) and a second input for receiving at least a part of the output voltage of the series stabilizer. A parallel stabilizer (D2) is arranged in parallel with the output of the series stabilizer. The parallel stabilizer is adapted to generate an output voltage equal to that of the series stabilizer.

8 Claims, 2 Drawing Sheets

SERIES VOLTAGE REGULATING CIRCUIT HAVING A PARALLEL STABILIZER

BACKGROUND OF THE INVENTION

This invention relates to a voltage-regulating circuit comprising, a series voltage stabilizer which comprises a regulation element which is arranged in series with an output for supplying an output voltage, and a comparison circuit for controlling the regulation element, which comparison circuit has a first input for connection to a reference-voltage circuit and a second input for receiving at least a part of the output voltage of the series stabilizer. Such a circuit is known from U.S. Pat. No. 4,341,990.

In order to prevent oscillations of the regulating circuit the known circuit employs frequency compensation in the form of a capacitor. However, this is at the expense of the rejection of high-frequency disturbances at the output of the regulating circuit.

SUMMARY OF THE INVENTION

It is an object of the invention to provide a voltage-regulating circuit of the type defined in the opening sentence in which the above-mentioned problem is avoided.

In accordance with the invention, this object is achieved in that a parallel stabilizer is arranged in parallel with the output of the series voltage stabilizer to generate an output voltage equal to that of the series stabilizer.

As a result of the low impedance of the parallel stabilizer and the resulting additional stabilization, high-frequency ripple is suppressed to a considerable extent.

Preferably, the reference voltage circuit comprises a parallel stabilizer similar to the parallel stabilizer connected to the output.

Since the parallel stabilizers are similar to one another, the requirement of equal output voltages of the series stabilizer and the parallel stabilizer is met.

Generally, the series voltage stabilizer corresponds to an operational amplifier. Since the parallel stabilizer employed as the reference-voltage circuit corresponds to the parallel stabilizer at the output of the regulating circuit, the operational amplifier will ensure that the voltage across the output of the parallel stabilizer at the output of the regulating circuit will always be the same, so that the current flowing in the latter will also be the same independently of the frequency-dependent output impedance of the operational amplifier.

In an advantageous embodiment, the parallel stabilizer forming the reference voltage circuit comprises the series arrangement of a plurality of diodes to which a current source is connected, and the parallel stabilizer connected to the output comprises a series arrangement of an equal number of diodes.

Suitably, the diodes are constructed as transistors having their collector base junctions short-circuited. When the base resistance of the transistors is smaller than the emitter differential resistance a favourable output impedance of the voltage-regulating circuit is obtained for high frequencies.

If, in addition, the transistors of the parallel stabilizer forming the reference voltage circuit have an emitter area smaller than that of the transistors of the parallel stabilizer at the output, this may be advantageous for the current consumption of the entire voltage-regulating circuit.

BRIEF DESCRIPTION OF THE DRAWINGS

The invention will now be described in more detail, by way of example, with reference to the accompanying drawings, in which.

DESCRIPTION OF THE PREFERRED EMBODIMENTS

Figure 1:
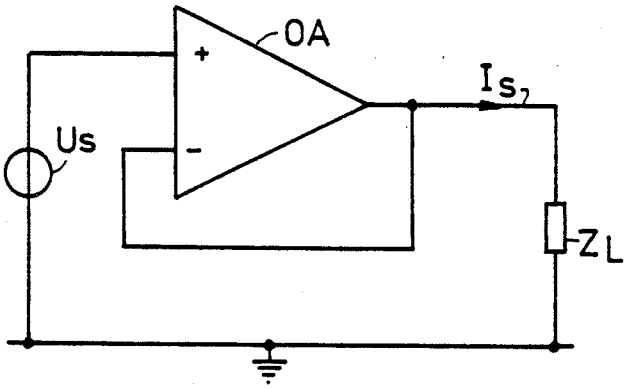
FIG. 1 shows a supply voltage-regulating circuit with series stabilization.

The circuit diagram of a supply voltage-regulating circuit with series stabilization, also referred to as a series stabilizer, will generally be as shown in FIG. 1. This series stabilizer comprises an operational amplifier OA to whose output, a load is connected. The output voltage of the series stabilizer, or in certain cases a part of this voltage, and a stable reference voltage $U_s$ are applied to the respective inputs of the operational amplifier. The operational amplifier compares said voltages and in the case of a difference the output is controlled to provide a balanced condition. Such a circuit performs satisfactorily if the open-loop gain of the operational amplifier is adequate and the output impedance of said amplifier is sufficiently low. For high frequencies this is not always the case and therefore the output impedance nearly always increases considerably as the frequency increases.

Figure 2:
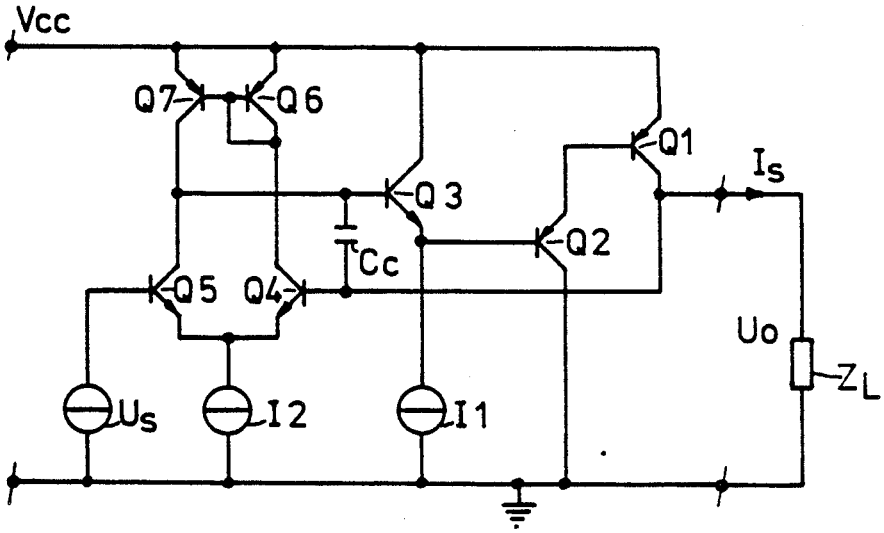
FIG. 2 shows an example of the series stabilizer in FIG. 1.

FIG. 2 shows an example of a series stabilizer in which the regulation element is an output transistor Q1 of the PNP type in common emitter arrangement. This output transistor is controlled by the comparison or differential amplifier, which comprises the transistors Q4 to Q6 and an associated current source I2, via the transistors Q2 and Q3 and the associated current source I1. The choice of the output configuration of the series stabilizer is dictated by the requirement that the voltage difference between the input voltage Vcc and the stabilized output voltage UO should be minimal. Consequently, the voltage drop across the series stabilizer should be minimal. The open-loop output impedance of this circuit is equal to the collector output impedance of the PNP output transistor $Q_1$ and is consequently very high. The output impedance of the negative-feedback operational amplifier is therefore largely determined by the open-loop gain. However, in view of the requirement as to immunity to oscillations, the output configuration requires a substantial frequency compensation, which in the present case is provided by the capacitor Cc. As a result of this, the open-loop gain already decreases at comparatively low frequencies, causing the output impedance to increase. The output impedance is of a highly inductive nature. This results in a poor suppression of high-frequency disturbances on the stabilized supply line.

In order to improve the suppression of high-frequency disturbances a parallel stabilizer PS1 is connected to the output of the series stabilizer. The equivalent diagram of this stabilizer is given in the right-hand part of FIG. 3. It is obvious that the impedance of this parallel stabilizer PS1 should remain low for high frequencies. This means that the output voltages of the series and the parallel stabilizer should be exactly equal because otherwise an uncontrolled current will flow in the parallel stabilizer. This requirement is met if a parallel stabilizer PS2, corresponding to the parallel stabilizer PS1 at the output of the control circuit, is employed for generating the reference voltage $U_s$ of the series stabilizer. This is illustrated symbolically in FIG. 3.

For high frequencies the gain of the operational amplifier decreases causing the output impedance of the series stabilizer to increase. This gives rise to a frequency-dependent current so that the current through the load is not well defined. Since a circuit PS1 identical to the reference voltage circuit, is arranged in parallel with the load ZL the same voltage will appear across the circuit PS1, so that the current through this circuit will also be the same independently of the output impedance of the operational amplifier.

Figure 3:
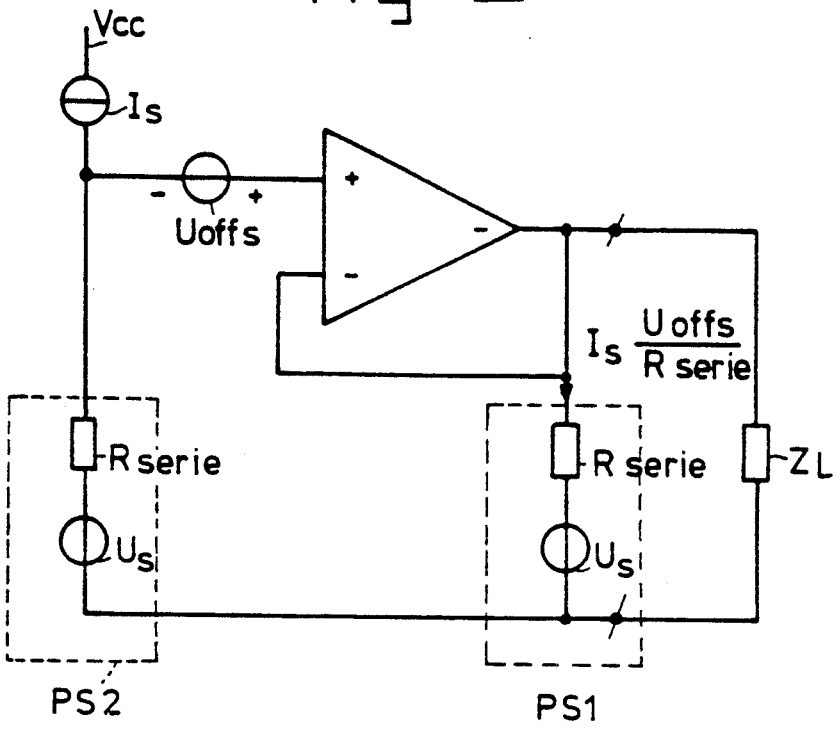
FIG. 3 shows an equivalent diagram of an embodiment of the invention.

FIG. 3 shows that the offset voltage of the series stabilizer appears on the output as an additional voltage and gives rise to an additional current in the series stabilizer, which additional current is equal to Uoffs/Rserie. In order to limit this current it is necessary that the series stabilizer have a reasonable series d.c. resistance.

Figure 4:
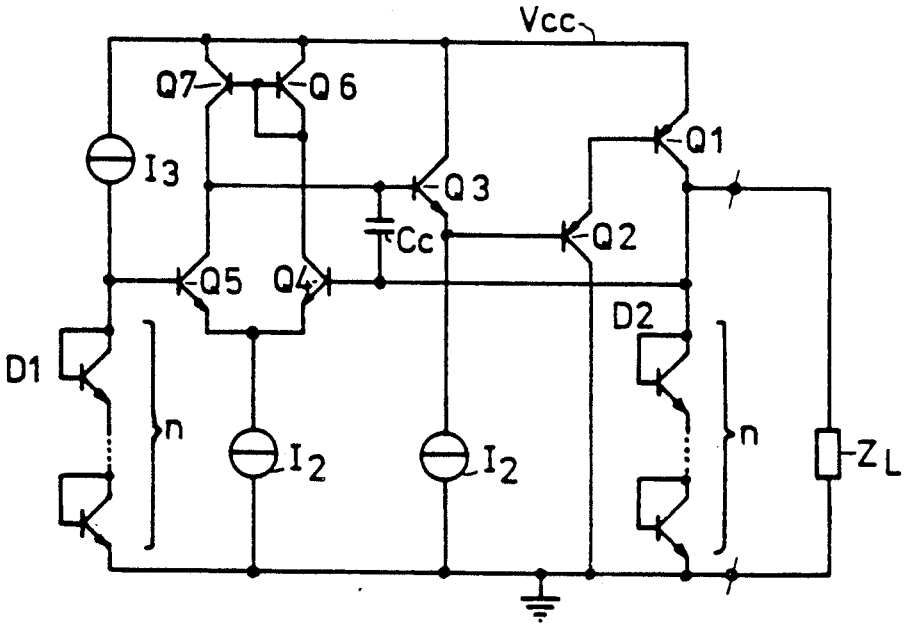
FIG. 4 shows a preferred embodiment of the invention.

FIG. 4 shows an embodiment of a circuit in accordance with the above-mentioned idea. Here, the parallel stabilizers PS1 and PS2 comprise a series arrangement of two or more diodes D1 and D2. The diodes D1 are driven by the current source Is.

The small signal series resistance of an integrated diode, in particular a diode-connected transistor, can be equal to kT/qI over a very large frequency range, so that the desired high-frequency output impedance can be dimensioned simply. The geometry of the diode-connected transistors should be selected in such a way that the base series resistance is minimal. If, for the selected bias current of the diodes, the base resistance is low in comparison with the emitter differential resistance $R_e$, the series resistance of the diodes remains low up to frequencies above Ft. This requirement applies in particular to the parallel stabilization at the output.

Preferably, a parallel stabilizer PS2 is employed which is identical to the parallel stabilizer PS1 and which is scaled in conformity with the current. The emitter areas of the stabilizing diodes for the reference voltage are selected to be smaller than those of the diodes at the output of the regulating circuit. The currents in the two stabilizing branches are then in the same ratio, which may be an advantage with respect to the current consumption of the entire circuit.

I claim:

1. A voltage regulating circuit comprising:

a series stabilizer which includes a control transistor connected between a terminal of a DC voltage source and an output terminal of the voltage regulating circuit, a comparison circuit comprising first and second transistors connected as a differential transistor pair with a first main electrode of each transistor connected in common via a current source to a point of reference voltage, a current mirror circuit coupling second main electrodes of said first and second transistors to said terminal of the DC voltage source, and means coupling a control electrode of the second transistor to said output terminal, a first parallel stabilizer coupled to said output terminal and to said point of reference voltage so as to develop an output voltage equal to that of the series stabilizer, a reference voltage circuit, which comprises a second parallel stabilizer identical to the first parallel stabilizer, coupled to a control electrode of the first transistor of the comparison circuit, and means coupling a control electrode of the control transistor to one of said second main electrodes of the differential transistor pair.

2. A voltage regulating circuit comprising: a series stabilizer which comprises a voltage regulation element connected in series with an output for supplying a regulated output voltage, a comparison circuit for controlling the regulation element, means connecting a first input of the comparison circuit to a reference-voltage circuit and a second input thereof to said output for receiving at least a part of the output voltage of the series stabilizer, a first parallel stabilizer circuit connected in parallel with the output of the series stabilizer to generate an output voltage equal to that of the series stabilizer, and wherein the reference voltage circuit comprises a second parallel stabilizer corresponding to the first parallel stabilizer.

3. A voltage-regulating circuit as claimed in claim 2 wherein the second parallel stabilizer comprises a series arrangement of a plurality of diodes connected to a current source, and the first parallel stabilizer comprises a series arrangement of an equal number of diodes.

4. A voltage-regulating circuit as claimed in claim 3, characterized in that the diodes comprise transistors having shortcircuited collector-base junctions and whose base resistance is smaller than the emitter differential resistance.

5. A voltage-regulating circuit as claimed in claim 3, wherein the diodes comprise transistors having shortcircuited collector-base junctions, the transistors of the second parallel stabilizer having an emitter area smaller than that of the transistors of the first parallel stabilizer.

6. A voltage regulating circuit comprising:

a series voltage stabilizer which includes a control transistor connected between a terminal of a DC voltage source and an output terminal of the voltage regulating circuit, a comparison circuit comprising first and second transistors connected as a differential transistor pair with a first main electrode of each transistor connected in common via a current source to a point of reference voltage, a current mirror circuit coupling second main electrodes of said first and second transistors to said terminal of the DC voltage source, and means coupling a control electrode of the second transistor to said output terminal, a parallel stabilizer coupled to said output terminal and to said point of reference voltage so as to develop an output voltage, a reference voltage circuit coupled to a control electrode of the first transistor of the comparison circuit and operative in a manner such that the output voltage of the parallel stabilizer is made equal to the output voltage of the series stabilizer, and means coupling a control electrode of the control transistor to one of said second main electrodes of the differential transistor pair.

7. A voltage regulating circuit comprising:

a series stabilizer which includes a control transistor connected between a terminal of a DC voltage source and an output terminal of the voltage regulating circuit, a comparison circuit comprising first and second transistors connected as a differential transistor pair with a first main electrode of each transistor connected in common via a current source to a point of reference voltage, a current mirror circuit coupling second main electrodes of said first and second transistors to said terminal of the DC voltage source, and means coupling a control electrode of the second transistor to said output terminal, a first parallel stabilizer coupled to said output terminal and to said point of reference voltage so as to develop an output voltage equal to that of the series stabilizer, wherein said first parallel stabilizer comprises at least one diode element coupled between said output terminal and said point of reference voltage, a reference voltage circuit which comprises a second parallel stabilizer including at least one diode element coupled between a control electrode of the first transistor and said point of reference voltage, and means coupling a control electrode of the control transistor to one of said second main electrodes of the differential transistor pair.

8. A voltage regulating circuit as claimed in claim 7 further comprising a second current source coupled between said terminal of the DC voltage source and said second parallel stabilizer.

* * * * *